US006343650B1

(12) United States Patent
Ringgenberg

(10) Patent No.: US 6,343,650 B1
(45) Date of Patent: Feb. 5, 2002

(54) TEST, DRILL AND PULL SYSTEM AND METHOD OF TESTING AND DRILLING A WELL

(75) Inventor: Paul D. Ringgenberg, Carrollton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/427,324

(22) Filed: Oct. 26, 1999

(51) Int. Cl.[7] ..... E21B 43/12

(52) U.S. Cl. ..... 166/250.17; 166/142; 166/387; 166/386; 166/133; 166/188; 166/124; 166/330; 166/334.2; 175/50; 175/230

(58) Field of Search ..... 166/250.01, 250.17, 166/142, 387, 386, 133, 188, 124, 330, 334.2; 175/50, 230

(56) References Cited

U.S. PATENT DOCUMENTS

| | | | | |
|---|---|---|---|---|
| 2,280,785 A | | 4/1942 | Boynton | |
| 2,831,542 A | | 4/1958 | Lynes et al. | 166/221 |
| 3,107,729 A | | 10/1963 | Barry et al. | 166/66 |
| 3,578,078 A | | 5/1971 | Shillander | 166/152 |
| 5,697,449 A | * | 12/1997 | Hennig et al. | |
| 5,799,733 A | | 9/1998 | Ringgenberg et al. | 166/264 |
| 5,842,528 A | * | 12/1998 | Johnson et al. | |
| 6,148,912 A | * | 11/2000 | Ward | |

FOREIGN PATENT DOCUMENTS

| | | |
|---|---|---|
| EP | 0 697 501 A2 | 2/1996 |
| EP | 0 856 636 A2 | 5/1998 |
| WO | WO 99/45236 | 9/1999 |

* cited by examiner

*Primary Examiner*—Roger Schoeppel
(74) *Attorney, Agent, or Firm*—Paul I. Herman; Neal R. Kennedy

(57) ABSTRACT

A test, drill and pull system for testing a well formation or zone of interest and further drilling of the well in a single trip into the wellbore. The system includes a surface readout tester valve, a rotation-operated reversing valve, a resettable packer, a packer lockout, a perforated anchor and a drill bit. In operation, the apparatus is run into the bottom of the well adjacent to the formation or zone of interest and the packer set and unset as desired. With the packer set, a surface readout tester valve probe is lowered into the apparatus on a wireline and latched into the tester valve so that multiple testing operations may be carried out if desired. After testing, the fluid recovery may be reversed out and analyzed by actuating the reversing valve by rotation of the tool string. Further, rotation engages the packer lockout such that when weight is picked upon the packer, the packer cannot be reset. After the packer lockout is engaged and the packer unset, further drilling operations may be carried out without removing the apparatus from the wellbore.

38 Claims, 3 Drawing Sheets

TEST, DRILL AND PULL SYSTEM AND METHOD OF TESTING AND DRILLING A WELL

BACKGROUND OF THE INVENTION

1. Field of the Invention

The present invention relates generally to apparatus and methods for servicing a well, and more particularly, to apparatus and methods for the early evaluation of a well after the borehole has been partially drilled and before casing has been cemented in the borehole such that testing of the well and further drilling may be carried out on a single trip of the tool into the well.

2. Description of the Prior Art

During the drilling and completion of oil and gas wells, it is often necessary to test or evaluate the production capabilities of the well. This is typically done by isolating a subsurface formation or a portion of a zone of interest which is to be tested and subsequently flowing a sample of well fluid either into a sample chamber or up through a tubing string to the surface. Various data, such as pressure and temperature of the produced well fluids, may be monitored downhole to evaluate the long-term production characteristics of the formation.

One commonly used well testing procedure is to first cement a casing in the wellbore and then to perforate the casing adjacent the formation or zone of interest. Subsequently, the well is flow-tested through the perforations. Such flow tests are commonly carried out with a drill stem test string located within the casing. The drill stem test string carries packers, tester valves, circulating valves and the like to control the flow of fluids through the drill stem test string.

Although drill stem testing of cased wells provides very good test data, it has the disadvantage that the well must first be cased before the test can be conducted. Also, better reservoir data can often be obtained immediately after the well is drilled and before the formation has been severely damaged by drilling fluids and the like.

For these reasons, it is often desired to evaluate the potential production capability of a well without incurring the cost and delay of casing the well. This has led to a number of attempts at developing a successful open-hole test which can be conducted in an uncased borehole.

One approach which as been used for open-hole testing is the use of a weight-set, open-hole compression packer on a drill stem test string. To operate a weight-set, open-hole compression packer, a solid surface must be provided against which the weight can be set. Historically, this is accomplished by a perforated anchor which sets down on the bottom. Prior to such drill stem testing, it is necessary to remove the drill string from the well and then run the test string into the well. Afterwards, if it is desired to further drill the well, the test string must be removed so that the drill string may be run back into the well for the additional drilling procedure.

Thus, there is a need for reducing the number of trips in and out of the well which reduces both the cost of testing and drilling and also allows the testing to be conducted at an early stage before significant damage is done to the formation or zone of interest. The present invention meets these needs by providing a testing system which allows an open-hole test to be carried out and then additional drilling to be done on the same trip into the well.

SUMMARY OF THE INVENTION

The present invention includes a well testing system and method of testing and drilling a well. Specifically, the apparatus is referred to as a test, drill and pull tool. This apparatus is adapted for use on a tool or drill string for testing in an uncased wellbore.

The apparatus comprises a packer having a set position for sealing engagement with the wellbore and packer and an unset position for disengagement from the wellbore, a tester valve in communication with the drill string and having an open position such that fluid from the well will flow into the drill string during a well test when the packer is set and further having a closed position, and a drill bit adapted for further drilling of the well after the packer lockout has been engaged. The packer is preferably a compression or squeeze packer which is set by setting down weight on the drill string and unset by picking up the drill string, the packer being resettable in this way without removal from the wellbore.

The apparatus may also comprise a packer lockout having an engaged position which prevents resetting of the packer when weight is set down on the drill string and packer after the packer has been set and subsequently unset. The packer lockout is preferably engaged by rotation of the drill string. When this packer lockout is engaged, the drill bit may be rotated. In one embodiment, the drill bit may be rotated by rotating the drill string, and in another embodiment, the drill bit may be rotated by a mud motor actuated by pumping mud down the drill pipe.

The tester valve may be a surface readout tester valve, and the apparatus may further comprise a valve probe latchably engagable with the tester valve. In the illustrated embodiment, the valve probe is connectable to a wireline on which the valve probe may be run into the wellbore and engaged with the tester valve. Pulling on the wireline will open the tester valve for the test, and slacking off on the wireline will close the tester valve. The valve probe may further comprise a sampler adapted for trapping a fluid sample during the well test and/or a flow meter or "spinner" for determining fluid flow rates therethrough during the well test.

The setting and unsetting of the packer and the testing of the well with a tester valve may be carried out any number of times as desired prior to actuation of the packer lockout.

The apparatus may also comprise an isolation valve in communication with the drill string and having a closed position for testing the well and an open position wherein the drill string is placed in communication with the well during a drilling operation. The isolation valve may be actuated by rotation of the drill string, or alternatively, the isolation valve may be configured such that it is pressure actuated.

The apparatus additionally comprises a perforated anchor between the packer and drill bit. The perforated anchor is in communication with the tester valve, and fluid may flow through the perforated anchor into the drill string during a well test. A check valve is provided in the anchor and adapted for allowing fluid to enter the drill string during the well test and preventing discharge of fluid from the anchor during a drilling operation with the drill bit.

Stated in another way, the apparatus of the present invention is adapted for use on a drill string in an uncased wellbore and comprises a packer having a set position for sealing engagement with the wellbore and an unset position disengaged from the wellbore, a tester valve in communication with the drill string and having an open position and a closed position, a valve probe connectable to the tester valve for actuating the tester valve between the open and closed positions thereof, and a drill bit adapted for further drilling of the wellbore. The packer is adapted such that, after a selected cycle of setting and unsetting of the packer, it cannot be reset, and the drill bit is adapted for further drilling after the selected cycle of setting and unsetting the packer. The prevention of resetting of the packer is preferably accomplished by a packer lockout which prevents resetting of the packer after the selected cycle of setting and unsetting the packer.

The invention also includes a method of testing and drilling a well which comprises the step of running a tool string into the well and positioning the tool string adjacent to a bottom portion of the well. This tool string comprises a length of drill pipe, a packer connected to the drill pipe, a tester valve, and a drill bit. The method further comprises the steps of setting the packer into sealing engagement with an uncased borehole of the well, opening the tester valve so that the fluid will flow from a formation or zone of interest into the tool string, closing the tester valve, locking the packer such that it cannot be reset, unsetting the packer, drilling the well deeper with the drill bit.

The step of opening the tester valve may comprise flowing fluid into the drill pipe and flowing at least a sample portion of the fluid through the drill pipe to the surface of the well.

After the step of closing the tester valve, and before the step of locking the packer, the method may further comprise repeating the steps of opening the tester valve and closing the tester valve as many times as desired. After the step of closing the tester valve, and before the step of locking the packer, the method may also comprise unsetting the packer and repeating the steps of setting the packer, opening the tester valve and closing the tester valve as many times as desired. The method may further comprise running the tool string out of the well, unlocking the packer, and repeating the previously mentioned steps.

The step of locking the packer may comprise actuating a packer lockout in the tool string, and in the preferred embodiment, this step is carried out by rotating the tool string.

The method of testing and drilling a well may further comprise the steps of running a valve probe into the drill string on a wireline, and latching the valve probe to the tester valve. The step of opening the tester valve comprises applying tension to the wireline, and the step of closing the tester valve comprises slacking off on the wireline.

During the step of drilling, fluid is pumped down the tool string while preventing flow of fluid from the well into the tool string. Drilling may be accomplished by rotating the tool string or pumping the fluid through a mud motor connected to the drill bit.

Additionally, the method may comprise trapping a fluid sample while fluid is flowing from the formation or zone of interest and/or measuring a flow rate of the fluid flowing from the formation or zone of interest.

Numerous objects and advantages of the invention will become apparent as the following description of the preferred embodiment is read in conjunction with the drawings which illustrate such embodiment.

DESCRIPTION OF THE PREFERRED EMBODIMENT

Figure 1:
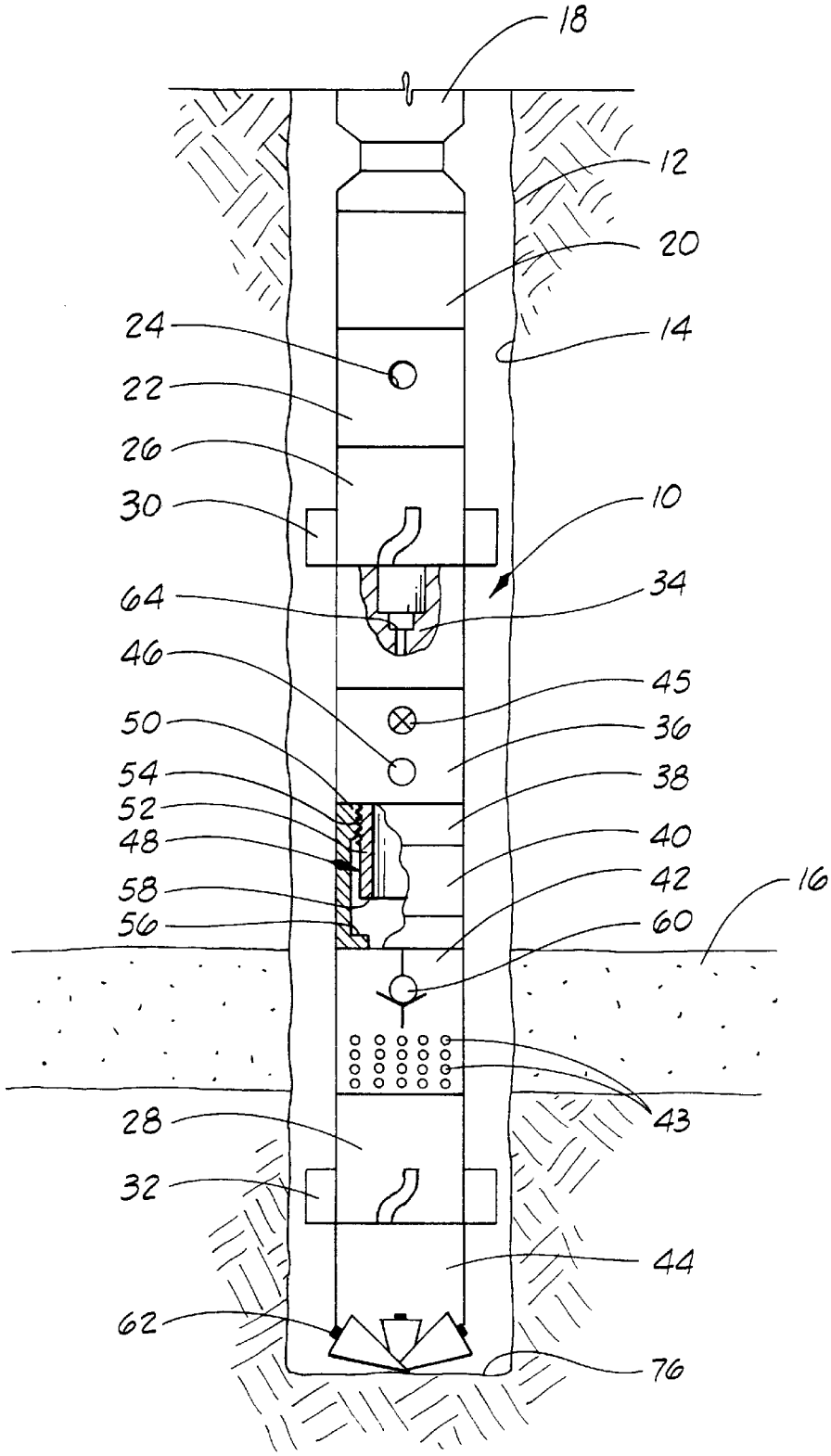
FIG. 1 illustrates the test, drill and pull testing of the present invention as it is run into a well and positioned adjacent to the bottom thereof.
Figure 2:
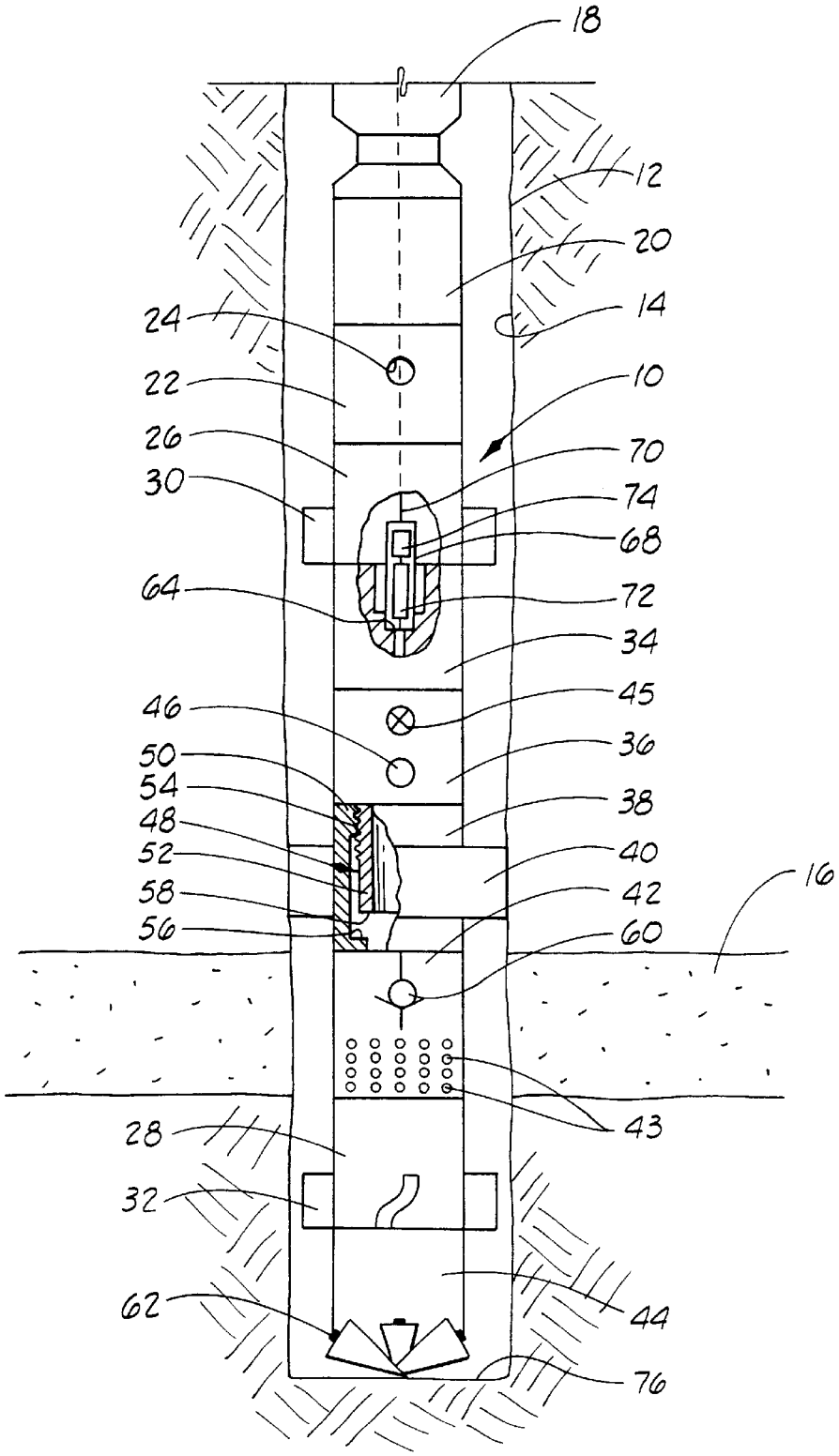
FIG. 2 illustrates the drill stem testing system in a testing position within the well adjacent to a formation or zone of interest.

Referring now to the drawings, and more particularly to FIGS. 1 and 2, the test, drill and pull system or apparatus of the present invention is shown and generally designated by the numeral 10.

Apparatus 10 is used in servicing a well 12 having an uncased borehole 14 intersecting a subsurface formation or zone of interest 16. As used herein, a reference to a method of servicing a well is used in a broad sense to include both the testing of a well wherein fluids are allowed to flow from the well and the treatment of a well wherein fluids are pumped into the well. "Servicing" also includes additional drilling. Also as used herein, a reference to a "zone of interest" includes a subsurface formation.

Apparatus 10 is at the lower end of a length of drill pipe 18 which extends to the surface. A predetermined number of drill collars 20 are utilized to make up the drill string including drill pipe 18 and apparatus 10 to the desired length.

Below drill collars 20 is a backup reversing valve 22 defining a reversing port 24 therein which may be placed in communication with drill pipe 18 as will be further described herein.

Apparatus 10 also includes a pair of spaced drill collars 26 and 28, each of which having a stabilizer 30 and 32 thereon, respectively. Stabilizers 30 and 32 guide apparatus 10 as it is lowered into borehole 14 and keep the apparatus substantially centered within the borehole. Stabilizers 30 and 32 may be referred to as upper stabilizer 30 and lower stabilizer 32.

Disposed between upper and lower stabilizers 30 and 32 apparatus 10 comprises a surface readout (SRO) tester valve, and a reversing valve 36, an open hole packer 38. In the illustrated embodiment, packer 38 is shown as a compression packer having an elastomeric packer element 40 thereon. Other types of packers could also be used, and the invention is not intended to be limited to a compression packer. Apparatus 10 also comprises a perforated anchor 42 defining a plurality of perforations 43 therein.

Below lower stabilizer 32 is a drill bit 44. Drill bit 44 may be actuated by rotation of drill pipe 18 and thus apparatus 10. Alternatively, drill bit 44 may be actuated by pumping fluid through a mud motor (not shown) of a kind known in the art.

Reversing valve 36 has an isolation valve 45 therein and also has at least one reversing port 46. Isolation 45 is a valve that isolates the dry drill pipe 18 from formation or zone of interest 16. Reversing ports 46 are normally closed as apparatus 10 is run into well 12, as is isolation valve 45. In a preferred embodiment, reversing valve 36 is rotation operated, and isolation valve 45 and reversing port 46 may be operated by a predetermined number of turns of drill pipe 18. In a specific embodiment, twenty turns are used to open isolation valve 45 and reversing port 46, but the invention is not intended to be so limited. More details of the operation of reversing valve 36 will be discussed further.

Also, as will be further discussed herein, the compression packer embodiment of packer 38 is placed in its sealing or set position by setting down weight on drill pipe 18 such that packer element 40 is compressed or squeezed until it expands outwardly to engage borehole 14, as best seen in FIG. 2. For other types of packers, the packer is set in the normal manner, such as by inflating a packer element on an inflatable packer.

Figure 3:
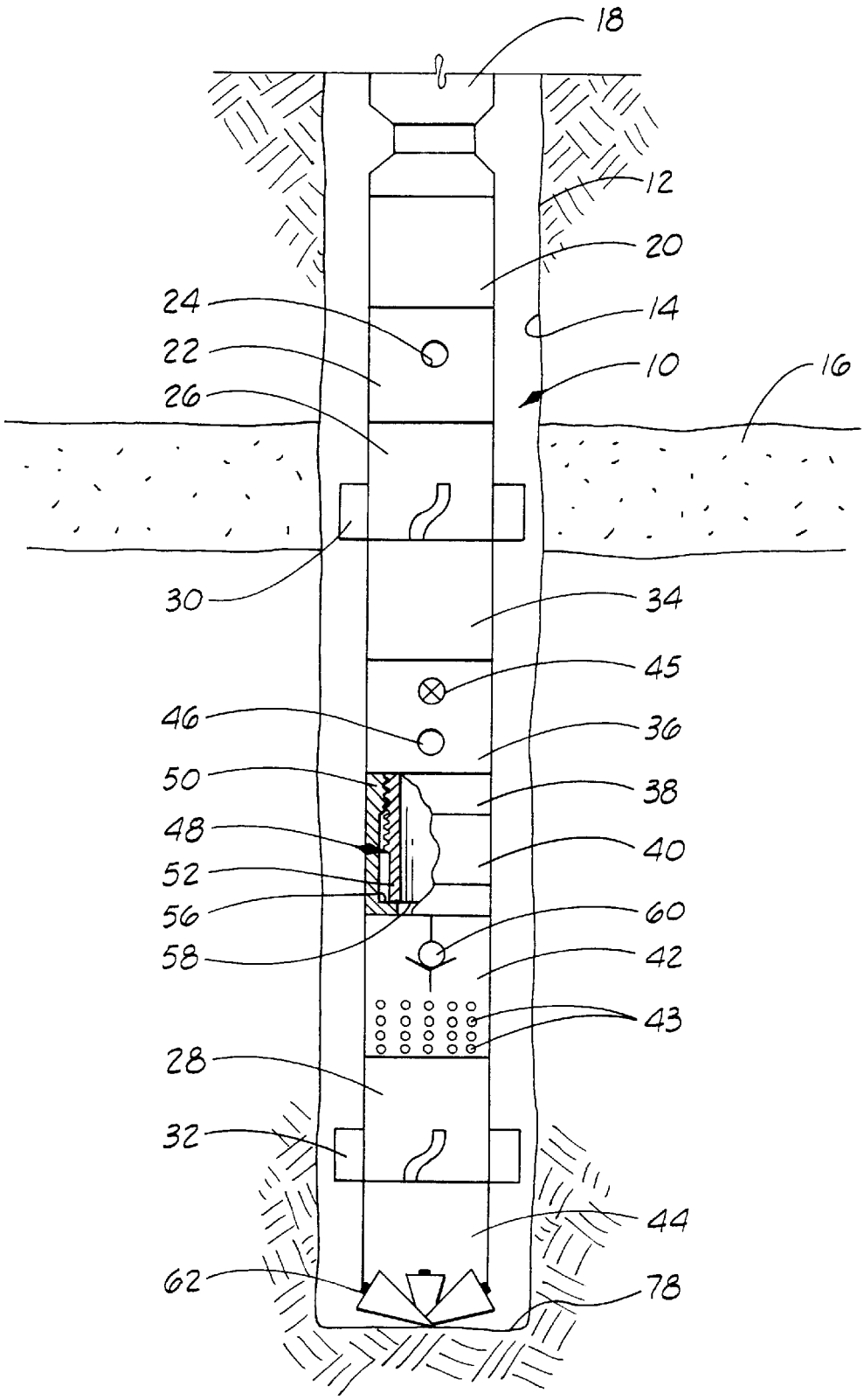
FIG. 3 illustrates the drill stem testing system as used to further drill the well after testing has been conducted.

Apparatus 10 also comprises a packer lockout 48 which has a disengaged position, as seen in FIGS. 1 and 2, in which packer 38 may be set into its sealing position. Packer lockout 40 also has an engaged position, as seen in FIG. 3, in which packer 38 is locked such that it cannot be reset when weight is again set down on drill pipe 18.

In the illustrated embodiment, packer lockout 48 includes a collar portion 50 of packer 38 which is threadingly connected to a lockout sleeve 52 in threaded connection 54. The lockout sleeve is attached to reversing valve 36 such that rotation of drill pipe 18 will cause rotation of lockout sleeve 52 with respect to collar portion 50. A shoulder 56 is formed in the lower portion of packer 38, and a lower end 58 of lockout sleeve 52 will engage shoulder 56 when packer lockout 48 is in its engaged position, as further described herein.

Perforated anchor 42 has a check valve 60 therein which allows fluid to flow into perforations 43, when flowing fluid out of formation or zone of interest 16, but which prevents flow through the perforations when drilling. Drilling mud pumped down through apparatus 10 is thus forced out jets 62 in drill bit 44 during drilling operations, as further described herein.

OPERATION OF THE INVENTION

Apparatus 10 is attached to drill pipe 18 and configured as previously described. Drill pipe 18 and apparatus 10 are run to the bottom 76 of borehole 14 of well 12 without filling drill pipe 18. That is, isolation valve 45 is closed, and the tool string is run with drill pipe 18 dry or at least partially dry to achieve an underbalance for testing. Borehole 14 has previously been drilled to the depth of bottom 76 in a conventional manner.

Packer 38 is set. For the illustrated compression packer, this is accomplished by setting down weight on drill pipe 18 and drill collars 20, thus expanding packer element 40 into sealing engagement with borehole 14. Other types of packers other than compression packers may be set in their conventional manner, such as by pumping fluid into an inflatable packer element. The packer may be set and unset any number of times as desired prior to actuation of the packer lockout.

Surface readout tester valve probe 68 is run into apparatus 10 on a wireline 70 and latched into latching surface 64 in SRO tester valve 34. Tension is applied to wireline 70 which opens tester valve 34 through the latched interaction of tester valve probe 68 which allows formation or zone of interest 16 to flow liquid into the previously "dry" drill pipe 18. That is, because drill pipe 18 is empty, or at least is at a lower pressure than the formation, when tester valve 34 is open, fluid is free to flow from formation or zone of interest 16 through perforations 43 in perforated anchor 42 and upwardly through apparatus 10. Testing may thus be carried out in a manner known in the arL By slacking off on wireline 70, tester valve 34 is closed for what is known as a "closed-in period." The steps of applying tension to wireline 70 to open tester valve 34 and slacking off on the wireline to close the tester valve may be repeated as many times as desired. During the test, flow meter 74 may be used to determine flow rates, and sampler 72 may be actuated to trap a fluid sample therein.

After testing has been completed, tester valve probe 68 is unlatched from latching surface 64 in tester valve 34 and removed from the tool by pulling on wireline 70. Tester valve probe 68 also may be configured such that fluid depths can be determined while pulling the probe out.

Packer 38 may be unset, such as by picking up weight on drill pipe 18. Other types of packers may be unset in a conventional manner, such as by deflating an inflatable packer element. Packer 38 may be set again and tester valve probe 68 latched again into tester valve 34 for another test. This cycle of setting packer 38, testing, and unsetting packer 38 may be carried out as many times as desired.

When no more testing is desired, drill pipe 18 is then rotated in a right-hand direction approximately twenty turns which opens reversing ports 46 and also opens isolation valve 45 in rotation-operated reversing valve 36. The fluid sample or "recovery" may then be reversed out of well 12 so that it can be analyzed.

After reversing out, drill pipe 18 is rotated in a right-hand direction approximately an additional twenty turns. This causes reversing ports 46 in rotation-operated reversing valve 36 to be closed while keeping isolation valve 45 open.

These additional twenty turns of rotation also engage packer lockout 48. That is, because of threaded connection 54, packer lockout sleeve 52 is moved downwardly during the rotation such that it engages shoulder 56 in packer 38, as shown in FIG. 3. Packer lockout 48 is adapted such that once tension is placed again on packer 38 to unseal it from borehole 14, weight can then be set down again on the illustrated compression packer without recompressing packer element 40 and resetting the packer. The engagement of lower end 58 of lockout sleeve 52 with shoulder 56 absorbs the weight so that packer element 40 is not recompressed.

Since packer 38 is locked out and cannot be reset, weight may thus be placed on drill bit 44 so that further drilling may be carried out. During the drilling operation, drilling mud is pumped down through drill pipe 18 and apparatus 10 to circulate out the cuttings. Drilling may be accomplished by rotating drill pipe 18 and apparatus 10, or alternatively, by pumping fluid through a mud motor (not shown) as previously mentioned.

Check valve 60 in perforated anchor 42 closes off the perforations and directs the mud to be discharged out drill bit 44 through jets 62 as previously mentioned. FIG. 3 illustrates the locked-out position of packer 38 by means of packer lockout 48 and also illustrates additional drilling with drill bit 44 to a new bottom 78 of well 12.

When the additional drilling is completed, drill pipe 18 and apparatus 10 may be pulled out of well 12 to the surface. Rotation-operated reversing valve 36 and packer lockout 48 may then be reset to their original positions. After this, apparatus 10 may be run back into well 12 to test the newly drilled portion of borehole 14 and for further drilling as desired.

Backup reversing valve 22 has been described as being activated by rotation, but it could also be an internal pressure operated reversing valve. Backup reversing valve 22 in such a pressure-operated configuration could be set higher than the expected circulating pressures while drilling. If opened, drill pipe 18 would have to be pulled because the fluid could not be circulated down to drill bit 44.

It will be seen, therefore, that the test, drill and pull system and method of the present invention are well adapted to carry out the ends and advantages mentioned, as well as those inherent therein. While a presently preferred embodiment of the apparatus and method have been described for the purposes of this disclosure, numerous changes in the arrangement and construction of parts in the apparatus and steps in the method may be made by those skilled in the art. All such changes are encompassed within the scope and spirit of the appended claims.

What is claimed is:

1. A method of testing and drilling a well comprising the steps of:

(a) running a tool string into the well and positioning the tool string adjacent to the bottom portion of the well, the tool string comprising:
a length of drill pipe;
a packer connected to the drill pipe;
a tester valve; and
a drill bit;

(b) setting the packer into sealing engagement with an uncased borehole of the well;

(c) running a valve probe into the drill string on a wireline;

(d) latching the valve probe into the tester valve;

(e) opening the tester valve by applying tension to the wireline so that fluid will flow from a zone of interest in the well into the tool string;

(f) closing the tester valve by slacking off on the wireline;

(g) unsetting the packer; and (h) drilling the well deeper with the drill bit.

2. An apparatus for use on a drill string for testing an uncased wellbore comprising:

a packer having a set position for sealing engagement with the wellbore and an unset position for disengagement from the wellbore;

a tester valve in communication with the drill string and having an open position such that fluid from the well will flow into the drill string during a well test when the packer is set and further having a closed position;

a packer lockout having an engaged position which prevents resetting of the packer after the packer has been set and unset; and a drill bit adapted for further drilling of the well after the packer has been set and unset, wherein the drill bit may be rotated after the packer lockout has been engaged.

3. The apparatus of claim 2 wherein the packer may be set and unset as desired prior to engagement of the packer lockout.

4. The apparatus of claim 2 wherein the packer lockout is engaged by rotation of the drill string.

5. An apparatus for use on a drill string for testing an uncased wellbore comprising:

a packer having a set position for sealing engagement with the wellbore and an unset position for engagement from the wellbore wherein:
the packer is placed in the set position thereof when weight is set down on the drill string; and
the packer is placed in the unset position thereof when weight is picked up on the drill string;

a tester valve in communication with the drill string and having an open position such that fluid from the well will flow into the drill string during a well test when the packer is set and further having a closed position;

a packer lockout having an engaged position which prevents resetting of the packer when weight is set down on the drill string and after the packer has been set and subsequently unset; and a drill bit adapted for farther drilling of the well after the packer has been set and unset, wherein the drill bit may be rotated after the packer lockout has been engaged.

6. The apparatus of claim 5 wherein the packer lockout is engaged by rotation of the drill string.

7. An apparatus for use on a drill string for testing an uncased wellbore comprising:

a packer having a set position for sealing engagement with the wellbore and an unset position for disengagement from the wellbore;

a tester valve in communication with the drill string and having an open position such that fluid from the well will flow into the drill string during a well test when the packer is set and further having a closed position;

a valve probe latchably engageable with the tester valve; and a drill bit adapted for further drilling of the well after the packer has been set and unset.

8. The apparatus of claim 7 wherein the valve probe is connectable to a wireline on which the valve probe may be run into the wellbore and engaged with the tester valve, whereby pulling on the wireline will open the tester valve for the valve test and slacking off on the wireline will close the tester valve.

9. The apparatus of claim 7 wherein the valve probe comprises a sampler adapted for trapping a fluid sample during the well test.

10. The apparatus of claim 7 wherein the valve probe comprises a flow meter for determining fluid flow rates therethrough during the well test.

11. An apparatus for use on a drill string for testing an uncased wellbore comprising:

a compression packer having a set position when weight is set down on the drill string for sealing engagement with the surface of the uncased wellbore and an unset position when weight is picked up on the drill string for disengagement from the wellbore;

a surface readout tester valve in communication with the drill string and having an open position such that fluid from the well will flow into the drill string during the well test when the packer is set and further having a closed position; and a drill bit adapted for further drilling of the wellbore after the packer has been set and unset without prior removal from the wellbore.

12. The apparatus of claim 11 wherein the packer is resettable without removal from the wellbore.

13. The apparatus of claim 11 further comprising a perforated anchor in communication with the tester valve through which the fluid may flow into the drill string during a well test.

14. The apparatus of claim 13 further comprising a check valve in the anchor adapted for allowing fluid to enter the drill string during the well test and preventing discharge of fluid from the anchor during drilling with the drill bit.

15. An apparatus for use on a drill string for testing an uncased wellbore comprising:

a compression packer having a set position when weight is set down on the drill string for sealing engagement with the surface of the uncased wellbore and an unset position when weight is picked up on the drill string for disengagement from the wellbore;

a tester valve in communication with the drill string and having an open position such that fluid from the well will flow into the drill string during the well test when the packer is set and further having a closed position;

a drill bit adapted for further drilling of the wellbore after the packer has been set and unset without prior removal from the wellbore; and an isolation valve in communication with the drill string and having a closed position for testing the well and an open position wherein the drill string is placed in communication with the well during drilling.

16. The apparatus of claim 15 wherein the isolation valve is actuated by rotation of the drill string.

17. The apparatus of claim 15 wherein the isolation valve is pressure actuated.

18. An apparatus for use in a drill string in an uncased wellbore comprising:

a packer having a set position for sealing engagement with the wellbore and an unset position disengaged from the wellbore, wherein the packer is a compression packer which is placed in the set position when weight is set down on the drill string and is placed in the unset position when weight is picked up on the drill string;

a packer lockout which may be actuated to prevent resetting of the packer after a selected cycle of setting and unsetting the packer;

a tester valve in communication with the drill string and having an open position and a closed position; and drill bit adapted for drilling of the wellbore.

19. The apparatus of claim 18 wherein the packer lockout is engaged by rotation of the drill string.

20. An apparatus for use in a drill string in an uncased wellbore comprising:

a packer having a set position for sealing engagement with the wellbore and an unset position disengaged from the wellbore;

a tester valve in communication with the drill string and having an open position and a closed position;

a valve probe connectable to the tester valve for actuating the tester valve between the open and closed positions thereof; and a drill bit adapted for drilling of the wellbore.

21. The apparatus of claim 20 wherein the probe is connectable to a wireline and adapted for latching onto the tester valve such that pulling on the wireline will open the tester valve and allow fluid to flow from the well into the drill string when the packer is in the set position and slacking off on the wireline will close the tester valve.

22. The apparatus of claim 20 wherein the valve probe comprises a sampler adapted for trapping a fluid sample during the well test.

23. The apparatus of claim 20 wherein the valve probe comprises a flow meter for determining fluid flow rates therethrough during the well test.

24. A method of testing and drilling a well comprising the steps of:

(a) running a tool string into the well and positioning the tool string adjacent to a bottom portion of the well, the tool string comprising:
a length of drill pipe;
a packer connected to the drill pipe;
a tester valve; and
a drill bit;

(b) setting the packer into sealing engagement with an uncased borehole of the well;

(c) opening the tester valve so that fluid will flow from a zone of interest in the well into the tool string;

(d) closing the tester valve;

(e) locking the packer such that it cannot be reset;

(f) unsetting the packer; and (g) drilling the well deeper with the drill bit.

25. The method of claim 24 further comprising, after step (d) and the step of locking, repeating steps (c) and (d) as desired.

26. The method of claim 24 further comprising, after step (d) and before the step of locking, unsetting the packer and repeating steps (b), (c) and (d).

27. The method of claim 24 wherein the step of locking comprises actuating a packer lockout in the tool string.

28. The method of claim 27 wherein the step of actuating the packer comprises rotating the tool string.

29. An apparatus for use in a drill string in an uncased wellbore comprising:

a packer having a set position for sealing engagement with the wellbore and an unset position disengaged from the wellbore;

a packer lockout which may be actuated to prevent resetting of the packer after a selected cycle of said setting and unsetting the packer;

a tester valve in communication with the drill string and having an open position and a closed position; and a drill bit adapted for drilling of the wellbore after setting and unsetting the packer.

30. The apparatus of claim 29 wherein the packer lockout is engaged by rotation of the drill string.

31. The apparatus of claim 29 wherein the packer is a compression packer which is placed in the set position when weight is set down on the drill string and is placed in the unset position when weight is picked up on the drill string.

32. The apparatus of claim 29 wherein the drill bit may be rotated for further drilling of the wellbore after the packer lockout has been engaged.

33. A method of testing and drilling a well comprising the steps of:

(a) running a tool string into the well and positioning the tool string adjacent to a bottom portion of the well, the tool string comprising:
a length of drill pipe;
a packer connected to the drill pipe;
a tester valve; and
a drill bit;

(b) setting the packer into sealing engagement with an uncased borehole of the well;

(c) locking the packer such that it cannot be reset;

(d) unsetting the packer; and (e) drilling the well deeper with the drill bit.

34. The method of claim 33 wherein step (c) comprises actuating a packer lockout in the tool string.

35. The method of claim 34 wherein the step of actuating the packer lockout comprises rotating the tool string.

36. The method of claim 33 further comprising, after step (b) and before step (c), the steps of:

opening the tester valve so that fluid will flow from a zone of interest in the well into the tool string;and closing the tester valve.

37. The method of claim 36 wherein the steps of opening and closing the tester valve are repeatable prior to step (c).

38. The method of claim 36 further comprising, after step (b) and before step (c), unsetting the packer and repeating the step (b) and the steps of opening and closing the tester valve.

* * * * *